US006197126B1

(12) United States Patent
Roland et al.

(10) Patent No.: US 6,197,126 B1
(45) **Date of Patent: *Mar. 6, 2001**

(54) NICKEL-FREE PHOSPHATING PROCESS

(75) Inventors: Wolf-Achim Roland, Solingen; Karl-Heinz Gottwald, Erftstadt; Matthias Hamacher, Huerth; Jan-Willem Brouwer, Willich, all of (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/313,179

(22) PCT Filed: Dec. 7, 1992

(86) PCT No.: PCT/EP92/02827

§ 371 Date: Sep. 30, 1994

§ 102(e) Date: Sep. 30, 1994

(87) PCT Pub. No.: WO93/20259

PCT Pub. Date: Oct. 14, 1993

(30) Foreign Application Priority Data

Mar. 31, 1992 (DE) ..... 42 10 513

(51) Int. Cl.[7] ..... C23C 22/07

(52) U.S. Cl. ..... 148/262; 148/273; 148/275; 428/628

(58) Field of Search ..... 148/262, 273, 148/275; 428/628

(56) References Cited

U.S. PATENT DOCUMENTS

| | | | | |
|---|---|---|---|---|
| 2,293,716 | | 8/1942 | Darsey | 148/262 |
| 4,865,653 | * | 9/1989 | Kramer | 148/262 |
| 5,207,840 | | 5/1993 | Riesop | 148/260 |
| 5,236,565 | * | 8/1993 | Müller | 148/262 |
| 5,261,973 | * | 11/1993 | Sienkowski | 148/262 |
| 5,268,041 | * | 12/1993 | Gehmecker | 148/262 |

FOREIGN PATENT DOCUMENTS

| | | |
|---|---|---|
| 2424382 | 12/1975 | (DE) . |
| 3920296 | 1/1991 | (DE) . |
| 4013483 | 10/1991 | (DE) . |
| 01868223 | 7/1986 | (EP) . |
| 0315059 | 5/1989 | (EP) . |
| 0398202 | 11/1990 | (EP) . |
| 0459541 | 12/1991 | (EP) . |

* cited by examiner

*Primary Examiner*—Deborah Jones
*Assistant Examiner*—Robert R. Koehler
(74) *Attorney, Agent, or Firm*—Wayne C. Jaeschke; Stephen D. Harper; Daniel S. Ortiz

(57) ABSTRACT

The invention is a process for applying a nickel-free, copper-containing phosphate coating to a metal surface by contacting the metal surface with a phosphate solution containing 0.2 to 2.0 g/l zinc ions, 0.5 to 25 mg/l copper ions, and 5–30 g/l phosphate ions.

18 Claims, No Drawings

NICKEL-FREE PHOSPHATING PROCESS

FIELD OF THE INVENTION

This invention relates to a process for the production of copper-containing nickel-free phosphate coatings on metal surfaces and to the use of the process as a pretreatment of the metal surfaces before lacquering, more particularly before cataphoretic dip lacquering (CDL).

BACKGROUND OF THE INVENTION

The quality of phosphate coatings before cataphoretic dip lacquering (CDL) depends upon a number of parameters, including physical parameters, such as the shape and size of the crystals, their mechanical stability and, in particular, the free metal surface after phosphating, the so-called pore area. Among the chemical parameters, alkali stability during cataphoretic coating, the binding strength of the water of crystallization of the zinc phosphate crystals during stoving of the lacquers and the rehydration capacity are of particular interest.

The weight of the coating can be controlled and, in particular, reduced by using activating agents before phosphating. Active centers from which crystal growth advances are formed on the metal surface by the polymeric titanium phosphates present in the activating agents. On the one hand, this results in smaller and mechanically more stable crystals, on the other hand the pore area is reduced in size which makes it more difficult for corrosive media to attack the lacquer coating in the event of damage.

RELATED ART

In the prior art, it has proved to be of advantage to provide a separate treatment bath in order optimally to influence the quality of the phosphate coating subsequently applied. However, the effective life of the activating baths is limited by carryover from the preceding cleaning baths. In particular, water hardness ions deactivate the polymeric titanium phosphates.

Accordingly, a search has been made for ways of obtaining a dense, substantially nonporous phosphate coating with a low weight per unit area by other methods or of producing such a coating in the phosphating bath itself in addition to activation. Extensive basic works have been carried out to this end. Some of these works were carried out at the Institute for Crystallography of the University of Cologne and resulted in the discovery of a new crystal phase $Ba_3(PO_4)_2.H_2O$ (Z. für Kristallographie 196, 312–313 (1991)). Although barium phosphate coatings do not contain any zinc, they have a number of positive properties, including in particular high thermal stability. Unfortunately, the coating weights obtainable are not sufficient to afford high protection against corrosion in combination with cataphoretic dip lacquering. Accordingly, barium phosphate coatings occupy an intermediate position between the "thin" iron phosphate coatings (0.3–0.5 g/m$^2$) and the "thicker" zinc phosphating coatings (2.0–3.5 g/m$^2$).

Aluminium ions reduce the weights of the phosphate coatings to an even greater extent, so that so-called "passivation phenomena", i.e. disturbances to the formation of zinc phosphate coatings, occur beyond a concentration of only 5 ppm $Al^{3+}$ ions in the phosphating bath.

Additions of magnesium ions have also been investigated. The positive effects of these ions on performance were recognized at an early stage (DE-A-39 20 296) and are based on several factors. The high crystal stability on heating is crucial in this case, too. The release of water of crystallization, which weakens the crystal structure and hence the system as a whole, is displaced to higher temperatures with increasing incorporation of magnesium. On the other hand, the crystals become smaller, the phosphate coating becomes denser and the free metal surface after phosphating is minimized by additions of $Mg^{+2}$ ions. The reduction in coating weight by magnesium ions is so considerable that other controlling factors which, normally, are also used for reducing coating weight, such as very low zinc concentrations (0.6 g/l $Zn^{2+}$), high concentrations of accelerators, such as sodium nitrite or meta-nitrobenzenesulfonate/Na salts, do not have to be additionally used to produce a weight per unit area of 1.5 to 2.0 g/m$^2$.

The influence of $Cu^{2+}$ ions has also been investigated. Additions of small quantities of copper ions to phosphating baths have been known for 40 years. Thus, in U.S. Pat. No. 2,293,716, very small quantities of $Cu^{2+}$ ions are added as "accelerators" or as "color neutralizers" to improve the whiteness of anodic electrodeposition lacquers. It was found that additions of copper increase the weight of the coating, particularly on steel.

DE-A-40 13 483 describes a process for phosphating metal surfaces in which phosphating solutions substantially free from nickel are used. Zinc, manganese and small contents of copper are mentioned as key bath constituents. In addition, the concentration of Fe(II) is kept below a maximum value by oxygen and/or other equivalent oxidizing agents. The process in question is used in particular for the pretreatment of metal surfaces for subsequent lacquering, more particularly electrode-position lacquering, and for the phosphating of steel, galvanized steel, alloy-galvanized steel, aluminium and alloys thereof.

EP-A-0 186 823 describes strongly acidic phosphating solutions with a pH value of 1.8 to 2.5 which contain 7.5 to 75 g/l of zinc ions, 0.1 to 10 g/l of hydroxylamine and optionally up to 20 g/l of manganese ions and also 5 to 75 g/l of nitrate ions. The solutions tolerate an iron content of up to 25 g/l.

A process for the zinc phosphating of iron-containing surfaces is known from EP-A-0 315 059. The desired morphology of the zinc phosphate crystals is established by the use of hydroxylammonium salts, hydroxylamine complexes and/or hydroxylamine. All the Examples contain nickel in addition to zinc as another layer-forming cation. The toxicological disadvantages of nickel are well-known.

BRIEF SUMMARY OF THE INVENTION

Accordingly, the problem addressed by the present invention was to provide a process for the production of nickel-free phosphate coatings which, despite the absence of nickel, would guarantee very firm lacquer adhesion and excellent corrosion protection on metal surfaces, such as cold-rolled steel, electrogalvanized steel and aluminium.

According to the invention, this problem has been solved by a specially selected phosphating solution which contains hydroxylamine salts, hydroxylamine complexes and/or hydroxylamine in a quantity of 500 to 5,000 ppm hydroxylamine, based on the phosphating solution, as the active component for modifying the crystal morphology ("accelerator"). With phosphating solutions such as these, it is possible to produce copper-containing phosphate coatings with a defined copper content and a defined edge length of the phosphate crystals.

In a first embodiment, therefore, the present invention relates to a process for the production of copper-containing nickel-free phosphate coatings with a copper content of 0.1 to 5% by weight and an edge length of the phosphate crystals of 0.5 to 10 μm on metal surfaces selected from steel, galvanized steel, alloy-galvanized steel, aluminium and alloys thereof by treatment of the surfaces by spraying, dipping or spraying/dipping with a phosphating solution containing the following components:

zinc ions 0.2 to 2 g/l copper ions 0.5 to 25 mg/l phosphate ions 5 to 30 g/l (expressed as $P_2O_5$)

and hydroxylamine salts, hydroxylamine complexes and/or hydroxylamine in a quantity of 500 to 5,000 ppm of hydroxylamine, based on the phosphating solution.

It has been found that, even in the absence of nickel, these phosphating solutions guarantee very firm lacquer adhesion and excellent corrosion protection on the metal surfaces mentioned above without the formation of any patches. The zinc phosphate coatings thus produced are made up of small (0.5 to 10 μm), compact and densely grown crystals.

DETAILED DESCRIPTION OF THE INVENTION

More particularly, the investigation of phosphating baths containing copper ions has shown that only very small quantities of copper ions are required in the solution to establish the desired copper content of the phosphate coating of 0.1 to 5% by weight.

In another preferred embodiment of the invention, therefore, the phosphating solution contains 5 to 20 ppm of copper ions when the metal surface is contacted with the phosphating solution by dipping. Where the phosphating solutions are applied by spraying, they preferably contain from 1 to 10 ppm of copper ions to incorporate correspondingly high copper contents in the conversion coating.

To guarantee satisfactory formation of the phosphate coating, it is known that the pH value of the phosphating solution can be adjusted to a value of 2.5 to 3.5. If necessary, other cations, for example alkali metal cations and/or alkaline earth metal cations, are used with corresponding anions known from the prior art to establish the pH value of the phosphating solution. Corrections to the pH value during the phosphating process may be made, for example, by additions of bases or acids.

Fine crystals which have a much more compact granular morphology rather than the known acicular structure are formed by the addition of manganese(II) ions, particularly where the phosphating solutions are sprayed onto surface-treated materials. The use of manganese ions in addition to zinc ions in low-zinc phosphating processes improves corrosion protection, particularly where surface-treated fine plates are used. The incorporation of manganese in the zinc phosphate coatings leads to smaller and more compact crystals with increased alkali stability. Accordingly, in one particularly preferred embodiment of the present invention, the phosphating solution contains 0.1 to 5 g/l, 0.15 to 5 g/l and, more particularly, 0.5 to 1.5 g/l of manganese(II) ions.

The quality of the copper-containing nickel-free phosphate coatings produced by the process according to the invention is not impaired if the phosphating solution contains alkaline earth metal cations in quantities of up to 2.5 g/l, more particularly magnesium and/or calcium ions.

The process according to the invention may be applied in particular to steel, steel galvanized on one or both sides, steel alloy-galvanized on one or both sides, aluminium and alloys thereof. In the context of the invention, the term steel is understood to encompass soft, non-alloyed steels in addition to low-alloyed steels and also more highly alloyed and high-strength steels. A key feature of the invention is that the aqueous acidic phosphating solutions are free from nickel. However, this does mean that, under industrial conditions, a small quantity of nickel ions may be present in the phosphating baths. In consistency with the prior art (DE-A-40 13 483), however, this quantity should be less than 0.0002 to 0.01 g/l and, more particularly, less than 0.0001 g/l.

Where the phosphating process is applied to steel surfaces, iron passes into solution in the form of iron(II) ions. By addition of suitable oxidizing agents, iron(II) is converted into iron(III) and may thus be precipitated as iron phosphate sludge. According to the invention, therefore, the phosphating solution typically contains up to 50 ppm—briefly even up to 500 ppm during production—of iron(II) ions.

A number of oxidizing agents are known from the prior art for limiting the concentration of iron(II) ions. For example, the concentration of iron(II) ions may be limited by contacting the phosphating solution with oxygen, for example atmospheric oxygen, and/or by addition of suitable oxidizing agents.

In a preferred embodiment of the invention, therefore, the phosphating solution contains oxidizing agents selected from peroxide compounds, chlorates, permanganates and organic nitro compounds.

According to the invention, the oxidizing agents for the phosphating solutions are preferably selected from peroxide compounds, more particularly hydrogen peroxide, perborate, percarbonate and perphosphate, and organic nitro compounds, more particularly nitrobenzenesulfonate. The quantities of oxidizing agent to be used are known from the prior art, the following quantities being mentioned by way of example: peroxide compound expressed as hydrogen peroxide 0.005 to 0.1 g/l, nitrobenzenesulfonate 0.005 to 1 g/l.

Where the phosphating process is applied to galvanized steel, alloy-galvanized steel, aluminium and alloys thereof, the presence of iron(II) ions is not harmful. Accordingly, there is no need at all to add oxidizing agents in the phosphating of these materials by the process according to the invention.

In addition, it has proved to be of particular advantage to use nitrate-free phosphating solutions in the phosphating of galvanized metal surfaces in accordance with the invention.

In another preferred embodiment of the invention, the phosphating solutions used are substantially free from nitrite ions. A major advantage of this variant of the invention is that no toxic decomposition products of nitrites, for example health-damaging nitrous gases, can be formed.

The use of modifying compounds from the group consisting of surfactants, hydroxycarboxylic acids, tartrate, citrate, hydrofluoric acid, alkali metal fluorides, boron trifluoride, silicofluoride, is known in principle from the prior art. Whereas the addition of surfactants (for example 0.05 to 0.5 g/l) leads to an improvement in the phosphating of lightly greased metal surfaces, it is known that hydroxycarboxylic acids, more particularly tartaric acid, citric acid and salts thereof in a concentration of 0.03 to 0.3 g/l contribute towards significantly reducing the weight of the phosphate coating. Fluoride ions promote the phosphating of metals which are relatively difficult to attack, leading to a reduction in the phosphating time and in addition to an increase in the surface coverage of the phosphate coating. The fluorides are known to be added in quantities of around 0.1 to 1 g/l. The controlled addition of fluorides also provides for the formation of crystalline phosphate coatings on aluminium and its alloys. Salts of boron tetrafluoride and silicon hexafluoride increase the aggressiveness of the phosphating baths which is noticeable in particular in the treatment of hot-galvanized surfaces, so that these complex fluorides may be used, for example, in quantities of 0.4 to 3 g/l.

Phosphating processes are typically applied at bath temperatures of 40 to 60° C. These temperature ranges are used both for spraying and for application by spraying/dipping and dipping.

The metal surfaces to be phosphated are cleaned, rinsed and, if necessary, treated with activating agents, more particularly based on titanium phosphates, by methods known per se before the phosphate coatings are applied.

The phosphating baths used to carry out the process according to the invention are generally prepared in the usual way known per se to the expert. Suitable starting products for the preparation of the phosphating bath are, for example, the following compounds: zinc in the form of zinc oxide, zinc carbonate and optionally zinc nitrate; copper in the form of acetate, sulfate or optionally nitrate; manganese in the form of the carbonate; magnesium and calcium in the form of the carbonates; phosphate preferably in the form of phosphoric acid. The fluoride ions optionally used in the bath are preferably used in the form of alkali metal or ammonium fluoride, more particularly sodium fluoride, or in the form of the complex compounds mentioned above. The compounds mentioned above are dissolved in water in the concentrations crucial to the invention. The phosphating solutions are then adjusted to the required pH value, as mentioned above.

In the context of the invention, hydroxylamine may emanate from any source. According to the invention, therefore, it is possible to use any compound which yields hydroxylamine or a derivative thereof, for example a hydroxylamine salt or a hydroxylamine complex which is often present in the hydrate form. Useful examples include hydroxylamine phosphate, optionally hydroxylamine nitrate, hydroxylamine sulfate (also known as hydroxylammonium sulfate [$(NH_2OH)_2.H_2SO_4$]) or mixtures thereof. Hydroxylamine sulfate and hydroxylamine phosphate are particularly preferred hydroxylamine sources.

EXAMPLES

Process Sequence

1. Degreasing with a commercial alkaline cleaner (Ridoline® 1558)

Quantity: 2%

Temperature: 55° C.

Time: 4 mins.

2. Rinsing with process water

Temperature: room temperature

Time: 1 min.

3. Activation with an activating agent containing oligo/polymeric titanium phosphates (FIXODINE®950)

Quantity: 0.1% in deionized water

Temperature: room temperature

Time: 1 min.

4. Phosphating with the solution mentioned in the Examples and Comparison Examples Quantities: see Examples and Comparison Examples 5. Rinsing with process water Temperature: room temperature Time: 1 min.

6. Passivation with a commercial passivation (DEOXYLYTE® 41)

Quantity: 0.1% by volume

Temperature: 40° C.

Time: 1 min.

7. Rinsing with deionized water

Example 1

Starting out from an aqueous solution of a bath composition in step 4 of the above-mentioned process sequence with the following ion concentrations: Zn 1.1 g/l, Mn 0.8 g/l, Cu 0.015 g/l, $PO_4^{3-}$ 17.5 g/l, $NO_3^-$ 2.0 g/l, $SiF_6^{2-}$ 0.95 g/l, $F^-$ 0.2 g/l, accelerator (hydroxylammonium sulfate) 1.7 g/l, total acid 22.7 points, free acid 0.9 points, surfaces of steel plate (Sidca) (Example 1a) and electrogalvanized fine plate (ZE) (Example 1b) were phosphated for 3 minutes at a temperature of 52 to 54° C., the corrosion protection results set out in Table 1 being obtained.

Comparison Example 1

Starting out from an aqueous solution of a bath composition in step 4 of the above-mentioned process sequence with the following ion concentrations: Zn 1.0 g/l, Mn 1.4 g/l, $PO_4^{3-}$ 16.9 g/l, $NO_3^-$ 2.0 g/l, $SiF_6^{2-}$ 1.0 g/l, $F^-$ 0.2 g/l, accelerator (hydroxylammonium sulfate) 1.8 g/l, total acid 21.8 points, free acid 0.9 points, surfaces of steel plate (Sidca) (Example 1a) and electrogalvanized fine plate (ZE) (Example 1lb) were phosphated for 3 minutes at a temperature of 52 to 54° C., the corrosion protection results set out in Table 1 being obtained.

Comparison Example 2

Starting out from an aqueous solution of a bath composition in step 4 of the above-mentioned process sequence with the following ion concentrations: Zn 1.0 g/l, Mn 0.7 g/l, Ni 0.9 g/l, $PO_4^{3-}$ 17.3 g/l, $NO_3^-$ 3.5 g/l, $SiF_6^{2-}$ 0.25 g/l, accelerator ($NaNO_2$) 0.15 g/l, bath temperature 50 to 52° C., total acid 21.7 points, free acid 1.1 points, surfaces of steel plate (Sidca) (Example 2a) and electrogalvanized fine plate (ZE) (Example 2b) were phosphated for 3 minutes at a temperature of 52 to 54° C., the corrosion protection results set out in Table 1 being obtained.

Examples 2a and 2b and Comparison Examples 3a and 3b

Starting out from an aqueous solution of a bath composition in step 4 of the above-mentioned process sequence with the following ion concentrations: Zn 1.0 g/l,Mn 0.8 g/l, Cu (see Table 2), $NO_3^-$ (see Table 2), $P_4^{3-}$ 13.7 g/l, $SiF_6^{2-}$ 0.95 g/l, $F^-$ 0.22 g/l, accelerator (hydroxylammonium sulfate) 2.0 g/l, total acid 20.0 points, free acid 1.2 points, electrogalvanized fine plate was phosphated for 1 minute at a temperature of 53° C. The test plates were then provided with a test paint of CDL and white finishing lacquer and subjected to the alternating climate test according to VDA 621-415. The results obtained after a test duration of 5 cycles are set out in Table 2.

Test Methods

The corrosion-inhibiting effect of the phosphate coating according to the invention was determined in accordance with the standards of the Verband der Automobilindustrie e.V. (VDA 621-414 (outdoor weathering) and VDA 621-415 (alternating climate test)).

Testing of the corrosion inhibiting effect of motor vehicle lacquers by outdoor weathering is used to determine the corrosion inhibiting effect of motor vehicle lacquers under the influence of natural weathering for the total multilayer lacquer finish as in the Example with no protection against light and with the additional burden of spraying with salt solution.

Test paints consisting of a typical automotive layer sequence of CDL, filler, white finishing lacquer (according to the Ford specification) are provided parallel to the longitudinal side with a straight score penetrating under control to the metal substrate. The test paints are stored on suitable frames. They are liberally sprayed once a week with a dilute sodium chloride solution.

In the present case, the test duration was 6 months.

For final evaluation, the test paints are rinsed with clear running water, optionally blown surface-dry with compressed air and inspected for visible changes. The visible creepage of rust from both sides of the score line is observed. The width of the metal surface damaged by rust adjacent the score line is generally easy to see on the paint surface. For evaluation, the average total width of the rust zone is measured in mm. To this end, the width is measured at several places and the arithmetic mean value is formed.

The object of testing the corrosion inhibiting effect of motor vehicle lacquers under cyclically varying load is to evaluate the corrosion inhibiting effect of motor vehicle lacquers by an accelerated laboratory process which produces corrosion processes and corrosion patterns comparable with those formed under actual driving conditions. The accelerated test simulates in particular the creepage of rust from damaged paint and also the margin and edge rusting of special corrosion test plates or components with known weak spots in the paint finish and also surface rust.

As in the outdoor weathering tests, test plates were again provided parallel to their longitudinal side with a straight score line penetrating to the metal substrate.

The test plates were set up at angles of 60° and 75° to the horizontal in the test apparatus.

One test cycle lasts 7 days and consists of 1 day=24 h salt spray mist testing–SS DIN 50 021

4 days=4 cycles condensation/alternating climate–KFW DIN 50 017 and 2 days=48 h room temperature (18 to 28° C.)–DIN 50 014.

The test duration comprises 10 cycles corresponding to 70 days.

On completion of the test, the test plates are rinsed with clear running water, optionally blown surface-dry with compressed air and inspected for visible changes. The visible creepage of rust from both sides of the score line is observed.

In general, the width of the metal surface damaged by rust adjacent the score line is readily visible in the form of blisters or traces of rust on the lacquer surface. In addition, the paint film with rust underneath can be carefully removed up to the firmly adhering zone with a blade, for example an erasing knife, held at an oblique angle.

For evaluation, the average total width of the rust creepage zone is again measured in mm. To this end, the width is measured at several places and the arithmetic mean value is formed.

TABLE 1

| | Corrosion test results 3-Layer lacquer system | | | | | | | | |
|---|---|---|---|---|---|---|---|---|---|
| | Outdoor weathering VDA 621-414 6 Months | | | Alternating climate test VDA 621-415 | | | | | |
| | Creepage mm | | | Creepage mm | | | Chipping value | | |
| Example 1 | | | | | | | | | |
| (a) Steel | 0.4 | 0.6 | 0.4 | 0.6 | 0.6 | 0.5 | 1–2 | 1 | 1 |
| (b) ZE | 0 | 0 | 0 | 0.9 | 0.8 | 1.0 | 1 | 1 | 1 |
| Comparison Example 1 | | | | | | | | | |
| (a) Steel | 0.5 | 0.6 | 0.8 | 0.5 | 0.8 | 0.9 | 1 | 1–2 | 1 |
| (b) ZE | 1.0 | 0.8 | 0.7 | 2.8 | 3.3 | 2.5 | 6 | 6 | 6 |
| Comparison Example 2 | | | | | | | | | |
| (a) Steel | 0.3 | 0.3 | 0.3 | 0.3 | 0.6 | 0.8 | 1 | 1 | 1 |
| (b) ZE | 0 | 0.3 | 0 | 1.6 | 1.0 | 1.3 | 1 | 1 | 1 |

TABLE 2

| | Ion concentrations in the bath | | |
|---|---|---|---|
| Example | Cu [ppm] | $NO_3^-$ [g/l] | Creepage under lacquer [mm] |
| 2a | 3 | — | 1.1–1.7 |
| 2b | 8 | — | 1.6–1.9 |
| Comp. 3a | 3 | 2 | 2.6–4.6 |
| Comp. 3b | 8 | 2 | 2.8–2.5 |

These Examples clearly show the positive influence of nitrate-free phosphating solutions in the phosphating of galvanized metal surfaces.

What is claimed is:

1. A process for the production of copper-containing nickel-free phosphate coatings with a copper content of 0.1 to 5% by weight and an edge length of the phosphate crystals of 0.5 to 10 $\mu$m on a metal surface selected from the group consisting of galvanized steel and alloy-galvanized steel which comprises contacting the surface with a phosphating solution containing:

a) zinc ions 0.2 to 2 g/l;

b) copper ions 0.5 to 25 mg/l;

c) phosphate ions 5 to 30 g/l (expressed as $P_2O_5$);

d) at least one member selected from the group consisting of hydroxylamine salts, hydroxylamine complexes and hydroxylamine in a quantity of 500 to 5,000 ppm of hydroxylamine, based on the phosphating solution; and e) manganese ions 0.1 to 5 g/l;

said phosphating solution being substantially free of nitrite ions.

2. The process as claimed in claim 1, wherein the phosphating solution contains up to 500 ppm of iron(II) ions.

3. The process as claimed in claim 1 wherein the phosphating solution contains from 5 to 20 ppm of copper ions and the metal surface is contacted with the phosphating solution by dipping.

4. The process as claimed in claim 1 wherein the phosphating solution additionally contains up to 2.5 g/l alkaline earth metal cations.

5. The process as claimed in claim 1 wherein the hydroxylamine salt comprises at least one member selected from the group consisting of hydroxylammonium phosphate, hydroxylammonium nitrate and hydroxylammonium sulfate.

6. The process as claimed in claim 1 wherein the phosphating solution additionally contains at least one oxidizing agent selected from the group consisting of peroxide compounds, chlorates, permanganates and organic nitro compounds.

7. The process as claimed in claim 1 wherein the phosphating solution is substantially free of nitrate ions.

8. The process of claim 1 further comprising lacquering the metal surface coated with the copper-containing, nickel-free phosphate coating of claim 1.

9. The process of claim 1 wherein the phosphating solution contains up to 50 ppm of iron(II) ions.

10. The process of claim 1 wherein the phosphating solution contains from 1 to 10 ppm of copper ions and the metal surface is contacted with the phosphate solution by spraying.

11. The process of claim 1 wherein the phosphating solution additionally contains from 0.5 to 1.5 g/l of manganese(II) ions.

12. The process of claim 2 wherein the phosphating solution contains from 5 to 20 ppm of copper ions and the metal surface is contacted with the phosphating solution by dipping.

13. The process of claim 2 wherein the phosphating solution additionally contains from 0.5 to 1.5 g/l of manganese(II) ions.

14. The process of claim 13 wherein the phosphating solution contains from 5 to 20 ppm of copper ions and the metal surface is contacted with the phosphate solution by dipping.

15. The process of claim 2 wherein the phosphating solution contains from 1 to 10 ppm of copper ions and the metal surface is contacted with the phosphate solution by spraying.

16. The process of claim 2 wherein the phosphating solution additionally contains from 0.15 to 5 g/l manganese (II) ions.

17. The process of claim 2 wherein the phosphating solution additionally contains up to 2.5 g/l of at least one of calcium or magnesium ions.

18. The process of claim 2 wherein the phosphating solution additionally contains 0.15 to 5 g/l manganese(II) ions, up to 2.5 g/l alkaline earth metal cations, an oxidizing agent selected from the group consisting of peroxide compounds, chlorates, permanganates and organic nitro compounds and the hydroxylamine comprises at least one compound selected from the group consisting of hydroxylammonium phosphate, hydroxylammonium nitrate and hydroxylammonium sulfate.

* * * * *